US006105625A

United States Patent [19]

Shimono et al.

[11] Patent Number: 6,105,625

[45] Date of Patent: Aug. 22, 2000

[54] WOVEN SLIDE FASTENER HAVING A FASTENER ELEMENT ROW ANCHORED TO A FASTENER TAPE

[75] Inventors: Muchiji Shimono; Akihiro Yagyu, both of Namerikawa; Eiji Nishida, Kurobe, all of Japan

[73] Assignee: YKK Corporation, Tokyo, Japan

[21] Appl. No.: 09/339,727

[22] Filed: Jun. 24, 1999

[30] Foreign Application Priority Data

Jun. 26, 1998 [JP] Japan ..... 10-180799

[51] Int. Cl.[7] ..... A44B 19/40; A44B 19/54; D03D 1/00

[52] U.S. Cl. ..... 139/384 B; 24/392

[58] Field of Search ..... 139/384 B; 24/392

[56] References Cited

U.S. PATENT DOCUMENTS

| | | | |
|---|---|---|---|
| 3,905,401 | 9/1975 | Steingruebner | 139/384 B |
| 4,334,556 | 6/1982 | Fröhlich et al. . | |
| 4,799,515 | 1/1989 | Ohfusa | 139/384 B |
| 5,472,019 | 12/1995 | Shimono | 139/384 B |

FOREIGN PATENT DOCUMENTS

| | | |
|---|---|---|
| 0 050 895 | 5/1982 | European Pat. Off. . |
| 0 448 265 | 9/1991 | European Pat. Off. . |
| 0 792 599 | 9/1997 | European Pat. Off. . |
| 63-53802 | 10/1988 | Japan . |
| 2-17161 | 4/1990 | Japan . |
| 7-31687 | 7/1995 | Japan . |

OTHER PUBLICATIONS

Patent Abstract of Japan, publication No. 0109 1802, vol. 099, No. 006, Apr. 11, 1989.

*Primary Examiner*—Andy Falik
*Attorney, Agent, or Firm*—Hill & Simpson

[57] ABSTRACT

A woven slide fastener in which displacements of element anchoring warps in a width direction of a fastener tape does not occur, flexibility of the fastener and smooth operation of a slider are ensured, and anchoring of a fastener element row is stable. Two anchoring warps disposed closest to coupling heads out of a plurality of element anchoring warps running over upper leg portions of the fastener element row run with and parallel to a double-picked foundation weft running under lower leg portions of adjacent elements and are woven in a width direction of a fastener tape body portion while interlacing with other element anchoring warps and foundation warps. Therefore, the element row can be anchored firmly, and the two anchoring warps do not fall off the elements, and other element anchoring warps also do not fall off of the elements.

6 Claims, 6 Drawing Sheets

WOVEN SLIDE FASTENER HAVING A FASTENER ELEMENT ROW ANCHORED TO A FASTENER TAPE

BACKGROUND OF THE INVENTION

1. Field of the Invention

The present invention relates to a woven slide fastener formed by weaving a coil-shaped element row formed of monofilament made of synthetic resin along one longitudinal edge portion of a fastener tape simultaneously with weaving of the fastener tape, and particularly to a woven slide fastener wherein the coil-shaped element row is not displaced in a width direction of the fastener tape and a stable anchoring form can be obtained.

In this specification, the term "coil-shaped element row" refers to an entire group including a large number of element units wherein each element unit has an upper leg portion and a lower leg portion extending substantially in parallel to each other respectively from upper and lower end portions of a coupling head and the upper and lower leg portions of the adjacent element units are successively connected to each other substantially in a U shape through a connecting portion. In the specification, the element unit is simply referred to as "element".

2. Description of the Related Art

A fastener element row formed by weft inserting by double pick monofilament made of synthetic resin and for constituting the coil-shaped fastener element row on one longitudinal edge portion of a fastener tape simultaneously with weaving of the fastener tape and by forming the monofilament into shapes of elements at the time of the weft inserting is integrated with the fastener tape by using a plurality of element anchoring warps which pass over upper leg portions of the respective elements and are woven into a foundation structure under lower leg portions of adjacent elements while interlacing with wefts. For such a woven slide fastener wherein the fastener element row is woven into and anchored to the fastener tape, there are conventionally many kinds of weaving structures of the anchoring warps. Two kinds of conventional representative weaving structures comprising element anchoring warps and fastener tape foundation structure which is partially applicable to the present invention will be described, but it will be understood that the weaving structure is not limited to the ones described here.

According to Japanese Patent Publication No. 2-17161, a fastener element row formed by weft inserting monofilament made of synthetic resin by double pick as constituting material of the fastener element row on one longitudinal edge portion of a fastener tape simultaneously with weft insertion in ground structure at the time of weaving of the fastener tape and by weaving the monofilament into the fastener tape while forming the monofilament into shapes of fastener elements is anchored and integrated by a plurality of element anchoring warps disposed over upper leg portions of respective elements. In this weaving structure, wefts constituting the foundation structure of the fastener tape are on a lower side of lower leg portions of the respective elements of the fastener element row and the element anchoring warps disposed to pass over the upper leg portions of the respective elements simply interlace mainly with the wefts disposed under the lower leg portions of the adjacent elements.

Also in a weaving structure as disclosed in Japanese Patent Publication No. 63-53802 or Japanese Utility Model Publication No. 7-31687, for example, similarly to the above structure disclosed in Japanese Patent Publication No. 2-17161, a fastener element row formed by weft inserting by double pick monofilament made of synthetic resin as constituting material of the fastener element row on one longitudinal edge portion of a fastener tape simultaneously with weft inserting of ground structure at the time of weaving of the fastener tape and by weaving the monofilament into the fastener tape while forming the monofilament into shapes of fastener elements is anchored and integrated by a plurality of element anchoring warps disposed over upper leg portions of respective elements. According to Japanese Patent Publication No. 63-53802 or Japanese Utility Model Publication No. 7-31687, however, the wefts which are constituting yarns of the fastener tape are weft inserted not only under lower leg portions of respective elements but also over the plurality of element anchoring warps running over the upper leg portions of the respective elements between adjacent two elements so as to form the foundation structure, and the element anchoring warps are wrung upward and downward by the wefts between the respective elements.

According to the weaving structure for anchoring the fastener element row as disclosed in the above Japanese Patent Publication No. 2-17161, however, the element anchoring warp disposed over the upper leg portions of the respective elements of the fastener element row is liable to be displaced in a lateral width direction of the fastener on the upper side of the element upper leg portions. Particularly, the element anchoring warps disposed over the respective element upper leg portions and near the coupling heads are liable to fall off the coupling heads. As a result, a posture of the fastener element row anchored to the fastener tape by weaving becomes unstable and a coupling split occurs in use of the slide fastener, which impairs the functioning of the slide fastener.

According to the weaving structure for anchoring the fastener element row as disclosed in the above Japanese Patent Publication No. 63-53802 or Japanese Utility Model Publication No. 7-31687, on the other hand, as compared with the above weaving structure, the displacements of the element anchoring warps disposed over the upper leg portions of the respective elements in the width direction of the fastener tape are prevented on the upper side of the upper leg portions of the elements and the anchored posture by weaving would be stable. However, the weaving structures of both the warps and wefts are made compact due to tightening of the wefts and a product is liable to lack flexibility.

In coupling of the opposed fastener element rows by the sliding movement of the slider, as shown in FIG. 6, a space between adjacent two coupling heads is necessary to be opened up temporarily in the slider S so as to receive an opposite coupling head. In the weaving structure for anchoring the fastener element row as disclosed in the above Japanese Patent Publication No. 63-53802 or Japanese Utility Model Publication No. 7-31687, such an opening up of the space between the coupling heads is not easy, the coupling is not smoothly carried out, and the slider is difficult to slide. Furthermore, because double-picked weft inserting of the wefts is carried out not only under the lower leg portions of the respective elements of the fastener element row but also between the adjacent two elements, a number of picks is doubled as compared with a normal number of picks. Therefore, increasing manufacturing speed is difficult and productivity is low.

SUMMARY OF THE INVENTION

It is an object of the present invention to solve the above-described problems and specifically to provide a woven slide fastener wherein, without deteriorating productivity, displacements of element anchoring warps in a width direction of a fastener tape are not generated, flexibility of the fastener and an easy operation of a slider are ensured, and a form of anchoring of a fastener element row is stable.

According to an aspect of the invention, there is provided a woven slide fastener formed by forming monofilament which is made of synthetic resin and constitutes a coil-shaped fastener element row into elements along one longitudinal edge portion of a fastener tape simultaneously with weaving of the fastener tape and successively and integrally weaving the elements into the fastener tape while anchoring upper leg portions of the respective elements by anchoring warps, wherein at least one element anchoring warp out of the plurality of element anchoring warps running over the upper leg portions of the fastener element row runs with and in parallel to a double-picked foundation weft running under lower leg portions of adjacent elements and is woven in across a fastener tape body portion while interlacing with other of the element anchoring warps and foundation warps.

A basic technical idea of the invention is that at least one or more of the plurality of element anchoring warps passing over the upper leg portions of the elements and woven into a foundation structure is bent in the weft direction (tape width direction) after it passes over the upper leg portion of the element and woven in across the tape body portion while interlacing with other element anchoring warps and the foundation warps together with the foundation weft woven in by double pick under the elements. With this structure, since a part of the element anchoring warps is woven into the foundation structure across the tape body portion while interlacing with other element anchoring warps, the elements are firmly anchored, relative displacements of the element anchoring warps and the elements from each other in the tape width direction are prevented, posture of the elements anchored to the tape are stabilized, and the element anchoring warps are prevented from falling off the coupling heads of the elements.

Furthermore, a number and thicknesses of the element anchoring warps are those normally employed in this type of woven slide fastener. Therefore, the above-described operations and effects can be obtained without using special yarns for anchoring the elements in addition to the element anchoring warps. Also, in order to ensure temporary opening of a space between the adjacent two elements in coupling of the elements, flexibility of the slide fastener is ensured such that a closing operation of the slide fastener can be further smoothly carried out, thereby preventing problems such as a coupling split.

Preferably, the at least one element anchoring warp woven in across the fastener tape body portion in a weft direction together with the foundation weft is at least one anchoring warp disposed closest to coupling heads of the element row. In this case, displacements of all the element anchoring warps along leg portions of the elements are effectively prevented.

Further preferably, the at least one element anchoring warp woven in across the fastener tape body portion in a weft direction together with the foundation weft is an anchoring warp disposed closest to connecting portions of the element row. In this case, the at least one element anchoring warp is woven in the tape width direction together with the foundation weft simultaneously with anchoring of the elements on a side of the connecting portions of the element row. Therefore, the entire elements can be integrated with the tape at the connecting portions. The elements can be further stably anchored onto the fastener tape by combining this structure with the above-described structure of element anchoring warp.

And preferably, the at least one element anchoring warp woven in across the fastener tape body portion together with the foundation weft is woven in for each of all adjacent elements. In other words, the at least one element anchoring warp woven in across the fastener tape body portion together with the foundation weft is uniformly distributed to the elements. With the structure, yarns weft-inserted by double pick under every element necessarily comprise both the element anchoring warp and the foundation weft. Therefore, a weaving structure of the fastener tape is proportioned, a form of the tape is stabilized, anchoring of the element row to the fastener tape is naturally stabilized, and the smooth sliding operation of the slider is ensured.

As a modified weaving manner of the element anchoring warp, the at least one element anchoring warp is woven in for every second element. In this case, in contrast to the former weaving manner of the element anchoring warp, lines in the weft direction are provided to the form of the fastener tape. However, because further flexibility as the slide fastener in the longitudinal direction is ensured, such a weaving structure is preferable depending on a use of the slide fastener.

As the most preferable aspect of the invention, the at least one element anchoring warp woven in across the fastener tape body portion in a weft direction together with the foundation weft is both an anchoring warp disposed closest to the coupling heads of the element row and an anchoring warp disposed closest to the connecting portions of the element row and the one anchoring warp and the other anchoring warp are respectively disposed on the respective elements while being displaced from each other by one element.

DESCRIPTION OF THE PREFERRED EMBODIMENTS

Figure 1:
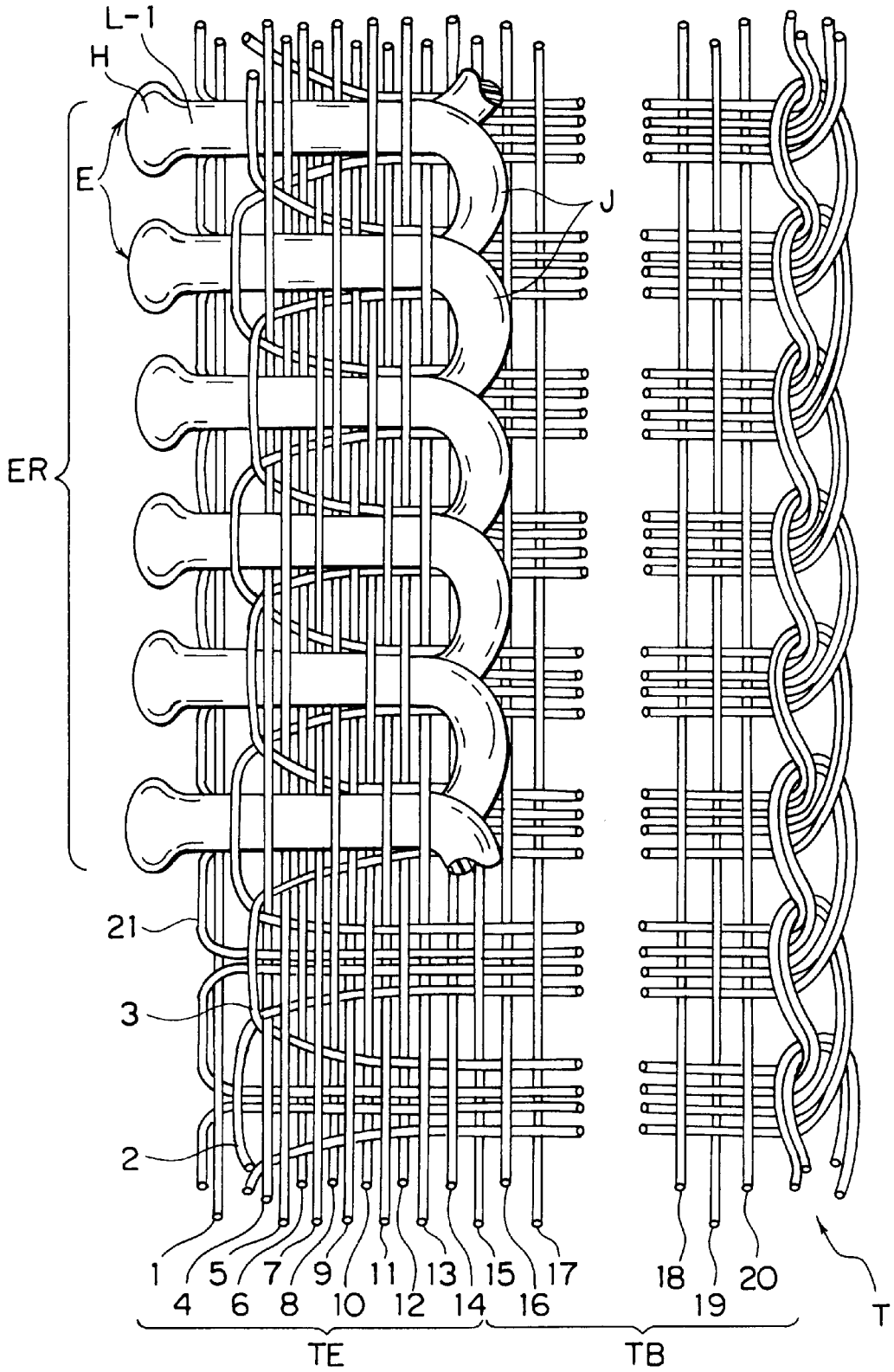
FIG. 1 is a schematic partial plan view of a woven slide fastener stringer with a part cut off, of a first embodiment of the present invention.

Embodiments of the present invention will be specifically described below referring to the drawings.

Figure 2:
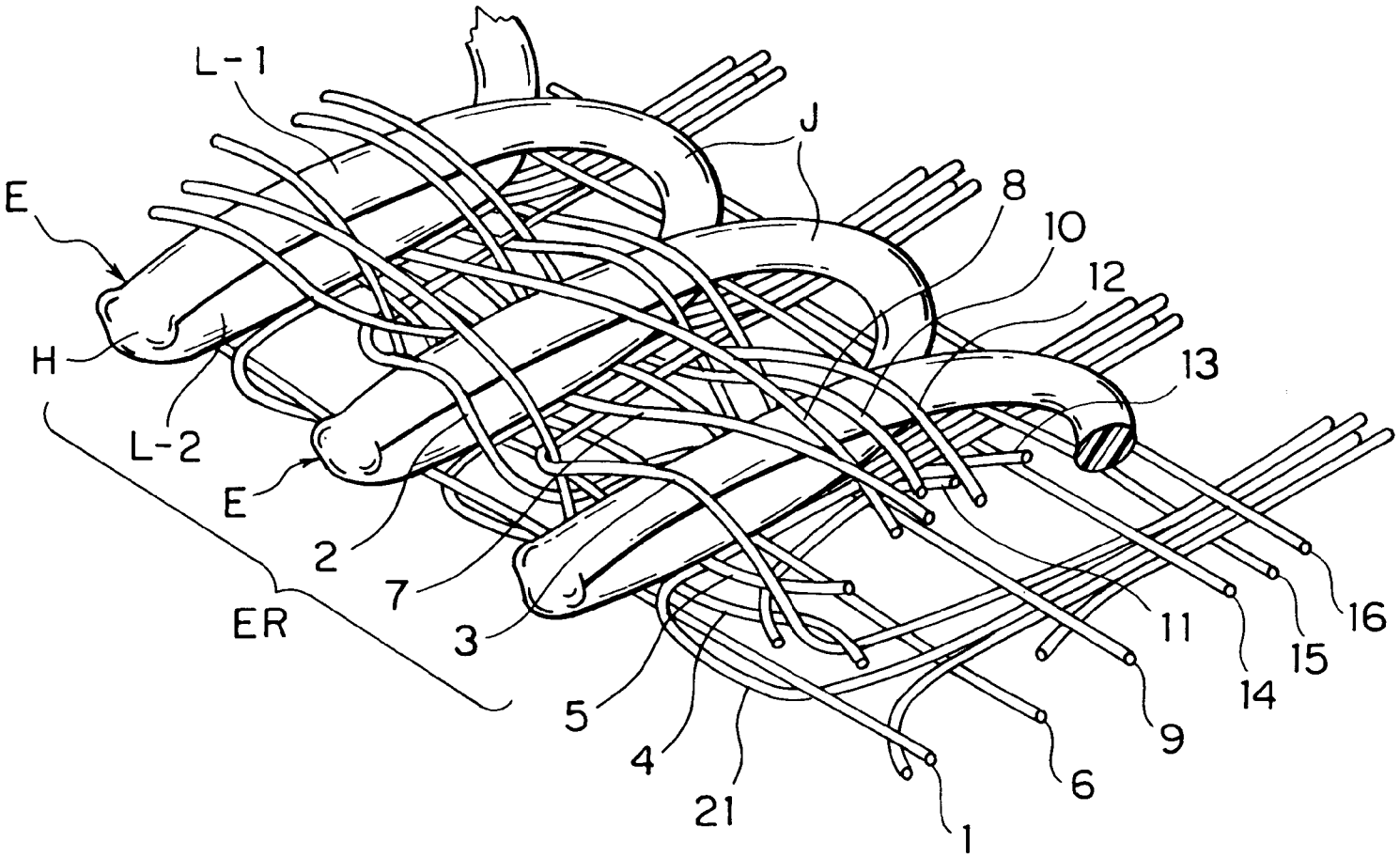
FIG. 2 is a partial perspective view of the slide fastener.

FIG. 1 is a plan view showing a part of a fastener stringer on one side, the stringer being a typical embodiment of the invention. In FIG. 1, an intermediate portion of a fastener tape body portion is omitted. FIG. 2 is a partial perspective view of a product shown in FIG. 1.

In FIGS. 1 and 2, various kinds of wefts and warps are shown to be relatively thin and a woven configuration (structure) is shown as rather loosely woven to facilitate an understanding of the invention. However, in light of a function as the fastener, yarns with necessary thicknesses are used as the various wefts and warps and the woven configuration (structure) is compact in an actual fastener such that the fastener can function properly.

The woven slide fastener of the embodiment is manufactured by weft inserting a monofilament made of synthetic resin by double pick, which is formed into a coil-shaped fastener element row on one longitudinal edge portion of a fastener tape T, simultaneously with weft inserting by double pick of a foundation structure of the fastener tape T and integrally weaving the monofilament into the fastener tape T while forming the monofilament into respective elements E.

The fastener element row ER comprises coupling heads H disposed substantially vertically to a fastener tape face, elements E each having upper and lower leg portions L-1 and L-2 respectively extending from upper and lower ends of the coupling heads H in a tape width direction of the fastener tape T and overlapping each other in a direction substantially vertical to the fastener tape face, and a connecting portion J for connecting the adjacent two elements E.

The fastener tape T comprises a large number of foundation warps 1, 6, 9, and 14 to 20 and a foundation weft 21 which is weft inserted by double pick while interlacing with the foundation warps 1, 6, 9, and 14 to 20. Because the monofilament made of synthetic resin is weft inserted simultaneously with weft inserting of the foundation weft 21 as described above, the double-picked foundation weft 21 exists only under the respective element lower leg portions L-2 of the fastener element row ER.

Element anchoring warps 2 to 5, 7, 8, and 10 to 13 for anchoring the fastener element row ER are disposed along one longitudinal edge portion of the fastener tape T separately from the above foundation warps 1, 6, 9, and 14 disposed along the one longitudinal edge portion of the fastener tape T, pass over each upper leg portion L-1 from a position close to the coupling head H of each element E toward a position close to the connecting portion J on an opposite side, and are divided into first, second and, third element anchoring warps 2, 3; 4, 5, 7, 8; and 10 to 13 disposed as shown in FIGS. 1 and 2.

The second and third element anchoring warps 4, 5, 7, 8; and 10 to 13 excluding the first element anchoring warps 2 and 3 disposed closest to the coupling heads H respectively run straight while passing over the element upper leg portions L-1 on a side of a body portion TB of the fastener tape and interlacing with the foundation weft 21 as described later, thereby weaving and anchoring the fastener element row ER.

According to the embodiment, the first element anchoring warps 2 and 3 comprise two yarns in total. The element anchoring warps 2 and 3 pass over each upper leg portion L-1 at a position close to the coupling head H of each element E of the fastener element row ER, run in parallel to a double pick of the foundation weft 21 which characterizes the invention, and are weft inserted by double pick while interlacing with the respective second and third element anchoring warps 4, 5, 7, 8; and 10 to 13.

In other words, in the embodiment, the first element anchoring warps 2 and 3 pass over an end portion closest to the coupling head H of the upper leg portion L-1 of one element E, respectively and successively bend in the tape width direction between the adjacent two elements E, run in parallel to the foundation weft 21 toward a selvage portion of the body portion TB of the fastener tape T, are folded back at the selvage portion, and return in the same opening portion until they interlace with the warp 4 which is closest to the coupling heads H in the second element anchoring warps 4, 5, 7, and 8. In other words, the first element anchoring warps 2 and 3 which are bent successively as described above are weft inserted together with the foundation weft yarn 21 by double pick weft inserting operations and interlace with the second and third element anchoring warps 4, 5, 7, 8; and 10 to 13 and with a large number of foundation warps 1, 6, 9, and 14 to 20. The above operations are repeated to form the fastener stringer.

Therefore, running of the first element anchoring warps 2 and 3 in the tape width direction is carried out together with weft inserting by double pick of the foundation weft 21 at the time of weaving of the fastener tape T. As a result, the first element anchoring warps 2 and 3 run in parallel to the foundation weft 21 and are woven into the above foundation warps 6, 9, and 14 to 20 as shown in FIGS. 1 and 2. In order to carry out a step of weft inserting of the first element anchoring warps 2 and 3 simultaneously with weft inserting of the foundation weft 21 as described above, a needle loom is suitable and the loom can be operated at a high speed.

The second and third element anchoring warps 4, 5, 7, 8; and 10 to 13 comprise four yarns which run straight in a longitudinal direction of fastener tape T in an intermediate area of each the element E and four yarns which similarly run straight on a side of the connecting portion J of each the element E as specifically shown in FIGS. 1 and 2. The number of the element anchoring warps to be used including the first element anchoring warps and the warp weaving structure can be changed arbitrarily depending on an application field of the slide fastener or other constituting members and are not limited to the example shown in the drawings.

The weaving structure according to the first embodiment shown in FIGS. 1 and 2 will be specifically described. The respective second element anchoring warps 4, 5, 7, and 8 run over the upper leg portions L-1 of the adjacent two elements E as bridging over them, run between the lower leg portion L-2 of the next element E and the double-picked foundation weft 21 disposed under the lower leg portion L-2, and pass under the lower leg portion L-2 of the further next element E and the double-picked foundation weft 21 disposed under the lower leg portion L-2. The respective second element anchoring warps 4, 5, 7, and 8 are disposed to be displaced from the adjacent second element anchoring warps in a direction of the element row ER by one element E.

In this manner, the four second element anchoring warps 4, 5, 7, and 8 are disposed with the above running units successively displaced by one element E and run repeatedly in the longitudinal direction of the fastener while anchoring the respective elements E to keep the elements E in balance. In other words, in the embodiment, the four second element anchoring warps 4, 5, 7, and 8 run by repeating a unit of "high-high-middle-low" across the adjacent four elements E with positions of the repeated units of the second element anchoring warps 4, 5, 7, and 8 displaced from each other.

In this case, in the "high-high" portion where the second element anchoring warps 4, 5, 7, and 8 run over the upper leg portions L-1 of the adjacent two elements E bridging over them, a necessary distance is maintained between the adjacent two elements. In the "high-middle-low" portion, the foundation weft 21 weft inserted by double pick and the respective elements E are in close contact with and anchored to each other, thereby integrally anchoring the fastener element row ER to the fastener tape T by weaving.

The four third element anchoring warps 10 to 13 running in the area close to the connecting portions J of the respective elements E run over the upper leg portion L-1 of one element and run under the double-picked foundation weft 21 disposed under the lower leg portion L-2 of the next element E as specifically shown in FIGS. 1 and 2. The third element anchoring warps 10 to 13 run by repeating the above in the longitudinal direction of the fastener stringer. In other words, in the embodiment, the respective third element anchoring warps 10 to 13 run by repeating a unit of "high-low". The adjacent two third element anchoring warps out of the four third element anchoring warps 10 to 13 run by repeating the units "high-low" with their positions displaced from each other by one element E in the longitudinal direction of the fastener stringer, thereby anchoring the respective elements E to keep the elements E in balance.

In this case, because two of the third element anchoring warps 10 to 13 run under the double-picked foundation weft 21 disposed under the lower leg portions L-2 of the respective elements E, the third element anchoring warps bring the respective elements E into close contact with the double-picked foundation weft 21 by cooperating with the above-described second element anchoring warps 4, 5, 7, and 8, thereby anchoring the respective elements E. Thus, the fastener element row ER can be further firmly and integrally anchored to the tape T and a smooth guiding property along guide flanges provided at side portions of the slider (not shown) can be obtained.

The respective second and third element anchoring warps 4, 5, 7, 8, and 10 to 13 are not limited to the embodiment shown in the drawings as described above. For example, the second element anchoring warps 4, 5, 7, and 8 successively run over the adjacent two element upper leg portions L-1 bridging over them and run under the double-picked foundation weft 21 disposed under the lower leg portion L-2 of the next element E with the positions of the second element anchoring warps 4, 5, 7, and 8 displaced from each other by one element E. The above is repeated in the longitudinal direction of the fastener stringer. In other words, the second element anchoring warps 4, 5, 7, and 8 may run by repeating a unit of "high-high-low". The third element anchoring warps 10 to 13 may run by repeating the above-described running unit of the second element anchoring warps 4, 5, 7, and 8, i.e. the unit "high-high-middle-low" or the unit "high-high-low".

Because the woven slide fastener according to the first embodiment of the invention has the above-described structure, the first element anchoring warps 2 and 3, running at the end portions closest to the coupling heads H, among the element anchoring warps running over the upper leg portions L-1 of the respective elements E continuously disposed in the fastener element row ER pass over the upper leg portions L-1 of the respective elements E, bend in the width direction of the fastener tape T, and are woven into while interlacing with the second and third element anchoring warps 4, 5, 7, 8; and 10 to 13 and the foundation warps 6, 9, and 14 to 20, together with the foundation weft 21. Therefore, the second and third element anchoring warps 4, 5, 7, 8; and 10 to 13 are tightened toward the selvage portion of the tape body portion TB, and as a result, the respective elements E are not displaced relatively not only to the first element anchoring warps 2 and 3 but also to the other second and third element anchoring warps 4, 5, 7, 8; and 10 to 13 and the element anchoring warps 2 and 3 near the coupling heads H do not fall off the elements E.

Figure 6:
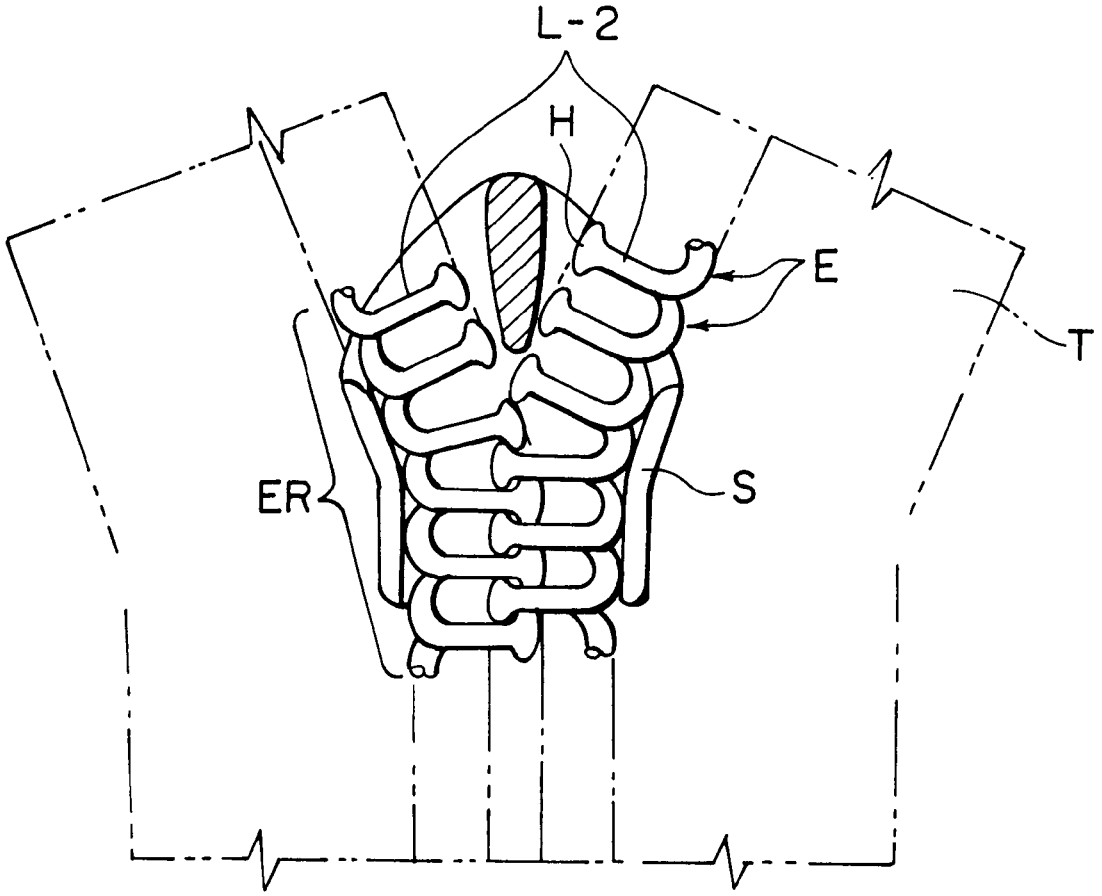
FIG. 6 is an explanatory view of movement of coupling elements when the slide fastener is closed by a slider.

Furthermore, with the above-described structure, a woven posture of the fastener element row ER is stabilized and a coupling split is not generated during use of the slide fastener. Because no yarns for restraining the element anchoring warps 2, 3; 4, 5, 7, 8; and 10 to 13 are woven into between the adjacent two elements E, the slide fastener is excellent in flexibility. Therefore, in coupling, for example, a space between the adjacent two coupling heads H can be easily opened up temporarily in the slider S as shown in FIG. 6. Thus, a slide fastener product wherein the coupling heads H can be smoothly coupled with coupling heads H of the opposite elements E and a light sliding operation of the slider can be obtained.

In the embodiment, in the area wherein the fastener element row ER is woven and anchored, the foundation warp 1 disposed at an outermost end edge of the fastener tape T is woven into a plain weave structure with the double-picked weft 21, and two other foundation warps 6 and 9 are respectively disposed at an intermediate portion of the above four second anchoring warps 4, 5, 7, and 8 and in a boundary area between the second anchoring warps 4, 5, 7, and 8 and the third element anchoring warps 10 to 13 and are interlaced with the foundation weft 21 running in parallel to the first element anchoring warps 2 and 3 running in the tape width direction at proper positions. With this structure, the fastener element row ER is laid on an upper face of the fastener tape T.

Figure 3:
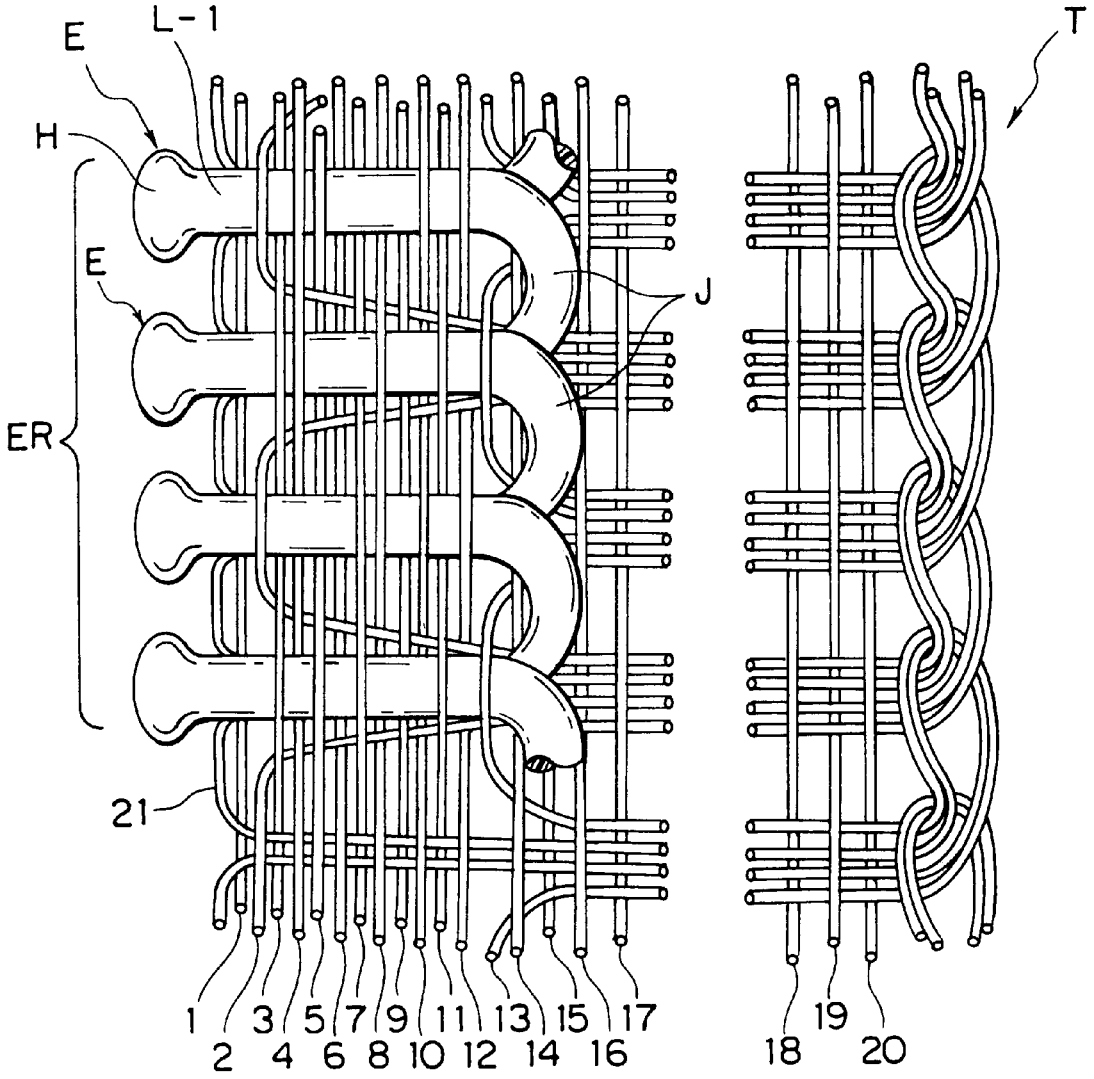
FIG. 3 is a schematic partial plan view of a woven slide fastener stringer with a part cut off, of a second embodiment of the invention.
Figure 4:
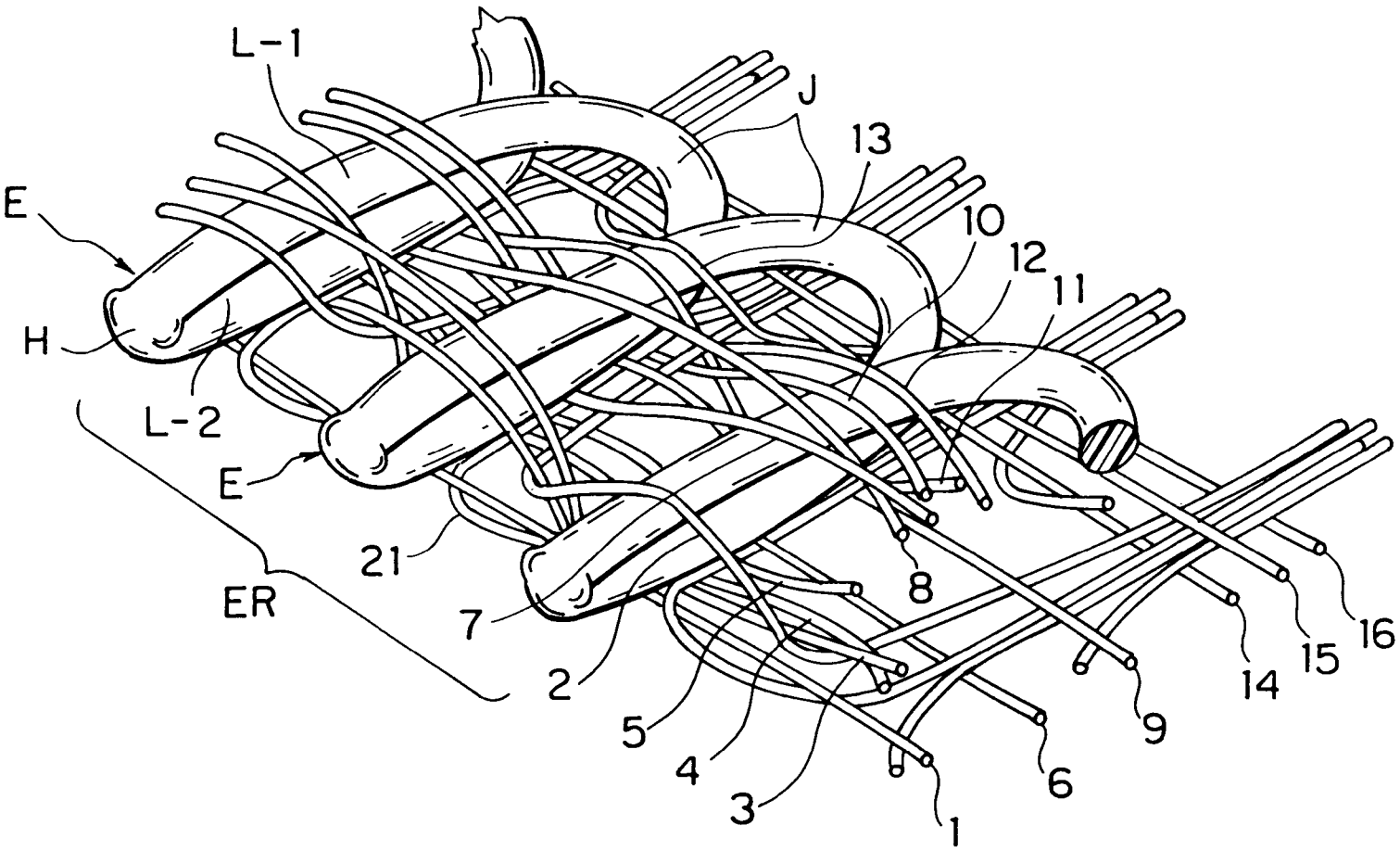
FIG. 4 is a partial perspective view of the slide fastener.

FIGS. 3 and 4 show a second embodiment of the invention. The differences from the above first embodiment will be described.

In the present embodiment, the number of the element anchoring warps is the same as that in the above first embodiment. However, the embodiment is remarkably different from the above first embodiment in that the element anchoring warps running over the upper leg portion L-1 of the element E and bending in the tape width direction are a first element anchoring warp 2 running at an end portion closest to the coupling head H of the element E and a third element anchoring warp 13 running at a position closest to the connecting portion J of the element E.

The first element anchoring warp 3 running at an end portion second closest to the coupling head H of the element E passes over the upper leg portion L-1 of one element E, passes under the double-picked foundation weft 21 disposed under the lower leg portion L-2 of the next element E, and passes over the upper leg portion L-1 of the further next element E in the embodiment. The first element anchoring warp 3 is woven into the fastener tape T by repeating the above.

The first element anchoring warp 2 running at an end portion closest to the coupling head H of the element E runs over the upper leg portion of the element E at a position where the element anchoring warp 3 passes under the element lower leg portion L-2, passes under the element anchoring warp 3 between the element E and the next element E, bends in the width direction of the tape T, and runs with the foundation weft 21 while interlacing with the second and third element anchoring warps 4, 5, 7, 8; and 10 to 12 and the foundation warps 14 to 20 excluding the third element anchoring yarn 13 running at the position closest to the connecting portion J of the element E.

The weaving structures of the second and third element anchoring warps 4, 5, 7, 8; and 10 to 12 excluding the third element anchoring yarn 13 running at the position closest to the connecting portion J of the element E are the same as those in the above first embodiment.

With the above structure, the element anchoring warp 2 disposed at the outermost end portion near the coupling head H on the upper leg portion L-1 of each element of the fastener element row ER does not fall toward the coupling head H and tightens all the other element anchoring warps 3; 4, 5, 7, 8; and 10 to 13 to prevent lateral displacements of the element anchoring warps 3; 4, 5, 7, 8; and 10 to 13.

On the other hand, the third element anchoring yarn 13 running at the position closest to the connecting portion J of the element E runs over the upper leg portion L-1 of an element E which is next to an element E, over the upper leg portion L-1 of which the first element anchoring warp 2 running at the end portion closest to the coupling head H of the element E passes over, bends in the tape width direction at an element connecting portion J which connects the above next element E and a further next element E, and runs in the width direction of the tape T together with the double-picked foundation weft 21.

With the above structure, the fastener element row ER can be firmly anchored to the tape T at a position near the element connecting portions J and a smooth guiding property along the guide flanges at the side portions of the slider (not shown) can be ensured.

Figure 5:
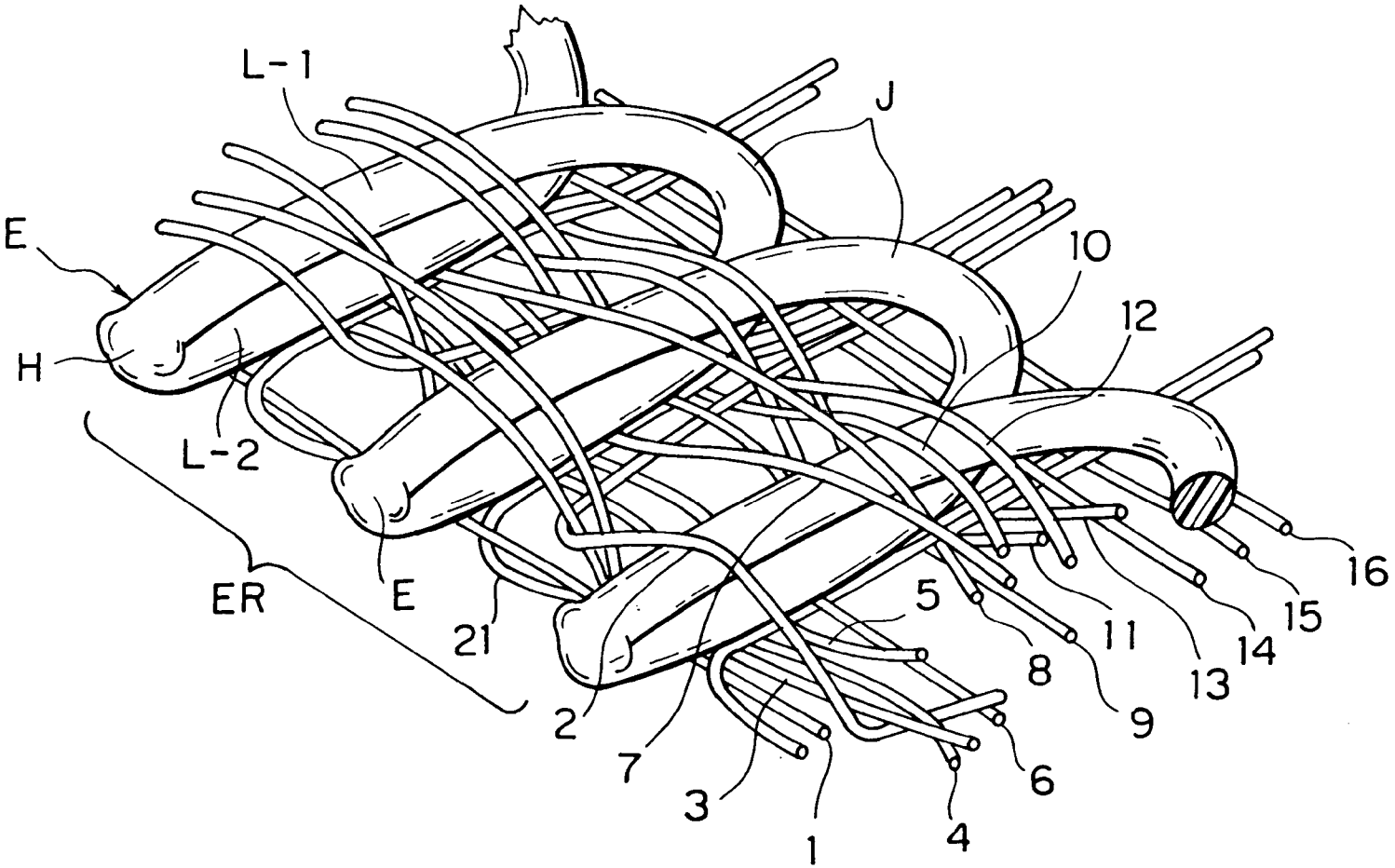
FIG. 5 shows an modification of FIG. 4.

It is also possible that the above-described third element anchoring yarn 13 running at the position closest to the connecting portion J of the element E does not bend at the connecting portions J and runs straight and alternately over the upper leg portion L-1 of one of the adjacent elements E and under the double-picked foundation weft 21 disposed under the lower leg portion L-2 of the other of the adjacent elements E as shown in FIG. 5 similarly to the first embodiment.

Although the invention has been described above based on the described embodiments, the invention is not limited to them. For example, any types of running of yarns may be employed as long as the element anchoring warps disposed over the upper leg portions L-1 excluding the element anchoring warp disposed near the coupling heads H of the element upper leg portions L-1 pass over the element upper leg portions L-1 and are woven into integrally with the foundation structure. The number and thicknesses of the warps are arbitrarily determined in light of a size of the fastener element row ER to be used, an engaging force as a fastener, and other functions.

What is claimed:

1. A woven slide fastener formed by forming monofilament which is made of synthetic resin and constitutes a coil-shaped fastener element row into elements along one longitudinal edge portion of a fastener tape simultaneously with weaving of said fastener tape and successively and integrally weaving said elements into said fastener tape while anchoring upper leg portions of said respective elements by a plurality of anchoring warps, wherein at least one element anchoring warp out of said plurality of element anchoring warps running over said upper leg portions of said fastener element row runs with and in parallel to a double-picked foundation weft running under lower leg portions of adjacent elements and is woven in across a fastener tape body portion while interlacing with other element anchoring warps and foundation warps.

2. A woven slide fastener according to claim 1, wherein said at least one element anchoring warp woven in across said fastener tape body portion in a weft direction together with said foundation weft comprises an anchoring warp disposed closest to coupling heads of said element row.

3. A woven slide fastener according to claim 1 or 2, wherein said at least one element anchoring warp woven in across said fastener tape body portion in a weft direction together with said foundation weft comprises an anchoring warp disposed closest to connecting portions of said element row.

4. A woven slide fastener according to claim 1 or 2, wherein said at least one element anchoring warp woven in across said fastener tape body portion in a weft direction together with said foundation weft is woven in for each of all adjacent elements.

5. A woven slide fastener according to claim 1 or 2, wherein said at least one element anchoring warp woven in across said fastener tape body portion in a weft direction together with said foundation weft is woven in for every second element.

6. A woven slide fastener according to claim 1, wherein said at least one element anchoring warp woven in across said fastener tape body portion in a weft direction together with said foundation weft comprises a first anchoring warp disposed closest to coupling heads of said element row and a second anchoring warp disposed closest to connecting portions of said element row, and said first and second anchoring warps are respectively disposed on said respective elements while being displaced from each other by one element.

* * * * *